US005468265A

United States Patent [19]

Adams

[11] Patent Number: 5,468,265

[45] Date of Patent: Nov. 21, 1995

[54] METHOD FOR TREATING COAL

[75] Inventor: Robert J. Adams, Pittsburgh, Pa.

[73] Assignee: RJA Associates, Pittsburgh, Pa.

[21] Appl. No.: 105,750

[22] Filed: Aug. 12, 1993

Related U.S. Application Data

[63] Continuation of Ser. No. 740,450, Aug. 5, 1991, Pat. No. 5,254,139.

[51] Int. Cl.[6] ..... C10L 5/00

[52] U.S. Cl. ..... 44/505; 44/626; 34/391; 34/393

[58] Field of Search ..... 44/626, 505, 634; 34/13

[56] References Cited

U.S. PATENT DOCUMENTS

| | | |
|---|---|---|
| 27,373 | 3/1860 | Mayhew . |
| 1,337,496 | 4/1920 | Wingett . |
| 1,708,740 | 4/1929 | Rohmer . |
| 1,772,189 | 8/1930 | McIntire . |
| 1,838,622 | 12/1931 | Herrick . |
| 1,893,857 | 1/1933 | Buck . |
| 1,925,132 | 9/1933 | Buck . |
| 2,697,068 | 12/1954 | Poindexter et al. . |
| 3,723,079 | 3/1973 | Seitzer . |
| 3,896,557 | 7/1975 | Seitzer et al. . |
| 3,961,914 | 6/1976 | Kindig et al. . |
| 4,120,665 | 10/1978 | Kindig et al. . |
| 4,123,332 | 10/1978 | Rotter . |
| 4,169,767 | 10/1979 | Noguchi et al. . |
| 4,192,650 | 3/1980 | Seitzer . |
| 4,221,570 | 9/1980 | Wasson ..... 44/634 |
| 4,259,083 | 3/1981 | Ignasiak . |
| 4,396,487 | 8/1983 | Strumskis . |
| 4,401,436 | 8/1983 | Bonnecaze . |
| 4,486,959 | 12/1984 | Chang . |
| 4,490,213 | 12/1984 | Anthony . |
| 4,523,927 | 6/1985 | Kuge et al. . |
| 4,769,042 | 9/1988 | Ito et al. . |
| 5,254,139 | 10/1993 | Adams ..... 44/626 |

OTHER PUBLICATIONS

Coal Combustion—Power from Coal Part II: A Special Report, *Power*, Mar. 1974.

*Primary Examiner*—Margaret Medley
*Attorney, Agent, or Firm*—Eckert Seamans Cherin & Mellott; Jolene W. Appleman; Arnold B. Silverman

[57] ABSTRACT

A method of treating coal. The method comprises passing the coal through a retort having a shell temperature of about 500°–1000° F. and shock heating the coal to a maximum surface temperature of about 500°–1000° F. without allowing the coal to become exothermic. The coal is prevented from going exothermic by a combination of factors, including the evaporation of moisture from the shock heated coal, the tendency of coal to absorb heat and maintain a temperature of about 390°–570° F. until the coal undergoes molecular transformation of complex hydrocarbons contained in the coal to simpler forms, and the effects of a cooling blanket gas passed through the shock heated coal. The blanket gas preferably comprises an oxygen lean blanket gas stream containing about 2–8% oxygen by volume. The treated coal exhibits extremely low moisture content and increased BTU value and other improved combustion characteristics.

12 Claims, 3 Drawing Sheets

METHOD FOR TREATING COAL

This is a continuation of application Ser. No. 07/740,450, filed Aug. 5, 1991 now U.S. Pat. No. 5,254,139 on Oct. 19, 1993.

FIELD OF THE INVENTION

The present invention relates to an improved fuel coal made by a method to improve the rank of the coal, such as by reducing the moisture content and altering the molecular structure of the coal to promote more efficient burning.

BACKGROUND OF THE INVENTION

Coal is one of the most abundant sources of fuel known. However, the quality and efficacy of different coals ranges widely, depending on where the coal is mined and the uses to which it is to be put. Coal generally contains moisture in amounts of up to about 50% by weight, which adds to coal transportation costs, decreases the heat value of the coal and favors formation of acid rain precursors upon burning the coal.

Generally, in order to burn efficiently, it is first necessary for the hydrocarbon components of coal to absorb heat, in order to liberate the moisture present and cause a molecular transformation of the complex hydrocarbons contained in the coal into more simple, more readily combustible hydrocarbons. This heat absorption is generally accomplished in the combustion zones of boilers and furnaces into which the coal is fed. However, this is a highly inefficient way to process the coal fuel, particularly for the lower rank, high moisture content coals and lignites, which require considerable energy and time for drying and for molecular transformation. Requiring the coal to absorb heat in the combustion zone also contributes to the production of both $NO_x$ and $SO_2$, the precursors of acid rain, since considerable excess air at elevated temperature and pressure is required to maintain suspension for the extended time required to burn the coal. This in turn provides excess oxygen for reaction with the sulfur and nitrogen in the combustion zone and in the flue gas stream.

The prior art contains numerous attempts to solve some or all of the above shortcomings of coal. Buck, U.S. Pat. No. 1,925,132 discloses a process of pretreating coal to 250°–450° F. to reduce moisture content and improve burning efficiency. However, this method only reduces moisture levels down to about 7% by weight, which precludes providing the heat energy necessary to simplify the molecular structure of the coal.

Other prior art techniques utilize high temperatures to drive off the moisture from the coal. See, for example, Wingert, U.S. Pat. No. 1,337,496. However, such high temperatures (800° C.) tend to drive off volatile components in the coal as well, thereby lessening its fuel value, and further tend to cause the coal to become exothermic.

Accordingly, it would be useful to provide a method of treating coal and to develop an improved fuel coal mode by the foregoing method to solve some or all of the above-noted problems.

It is therefore an object of the invention to provide a method for increasing the rank of coal.

It is another object of the invention to lower the ignition temperature of certain treated coals relative to untreated (raw) coal.

It is another object of the invention to provide a method for treating coal to reduce the formation of acid rain precursors.

It is still another object of the invention to provide a method of treating coal and thereby remove substantially all of the moisture from the coal.

It is a further object of the invention to render the treated coal substantially impenetrable to moisture reabsorption.

These and other objects of the invention will become apparent as the following detailed description of the preferred embodiments of the invention proceeds.

SUMMARY OF THE INVENTION

According to the present invention, coal containing up to about 50% moisture by weight of the coal, and sized up to about 2" maximum×0", is fed continuously into a retort, the retort having a shell temperature of as high as about 500°–1000° F. The bottom of the retort is heated externally, for example, with flame applied to the retort, preferably from a natural gas-fired flame, or from a slagging combustor using treated coal as fuel or with hot gases.

The temperature of the coal in the retort is not permitted to go so high as to allow the coal to become exothermic. The coal is quickly shock heated to drive off moisture and then quickly cooled with a blanket gas containing about 2–8% oxygen by volume of the blanket gas. This amount of oxygen, which is less than the oxygen content of air, also acts as a catalyst, speeding up the chemical and physical changes in the coal being treated.

Since the coal emits variable amounts of oxygen-containing air as it heats, the oxygen content of the blanket gas is preferably continuously monitored to maintain the preferred oxygen content in the blanket gas entering the retort.

The blanket gas changes the atmosphere within the retort continuously, generally about once per minute. In laboratory practice, this blanket gas is a mixture of oxygen and nitrogen. In commercial practice, the blanket gas comprises a mixture of oxygen and combustion gases, such as flue gas.

The temperature of the blanket gas is about 300°– 450° F. The flow rates of coal and blanket gas and the retort shell temperature are controlled such that the coal being treated never reaches an internal temperature above about 550° F. Preferably, the treated coal achieves a surface temperature of about 350°–550° F. This coal temperature is substantially uniform throughout the coal particles exiting the retort. This results from shock heating the surface of the coal at the inlet end of the retort, which shock heating radiates heat to the interior of the coal as the coal's surface is being cooled by the evaporation of water from the coal and by the blanket gas entering the outlet end of the retort.

The retort is functionally separated into two sections. The first section is a drying section, in which the greatest heat is applied such that the coal achieves its highest temperature, (surface temperature of about 500°–1000° F.), driving off substantially all of the moisture contained in the coal. The second section is a treating section, in which lower heat is applied to the retort shell and the coal is quickly cooled by the blanket gas and water evaporation to the 350°–550° F. surface temperatures previously described, before the coal can go exothermic.

It is also an important advantage of a preferred embodiment of the invention that volatile combustible materials are not driven off from the coal during the treating process. As used herein, the term "volatiles" and "volatile combustibles"

refers to those organic materials having a boiling point of about 450° C. or higher. Although the process of the invention drives off water and breaks down carboxyl bonds and weakens hydroxyl bonds in the coal, it does not reach sufficiently high temperatures for sufficiently sustained periods of time to drive off volatiles from the coal or volatilize the coal.

As used herein, the term "coal" is intended to refer to anthracite coals, all ranks of bituminous coals, sub-bituminous and lignite coals and peat.

The above process results in treated coal, also referred to herein as "alternative fuel," having a moisture content of 1% or less, and in some cases as low as 0.1% and even 0%. The process results in generation of $CO_2$, believed to be formed as a result of the breakage of carboxyl bonds in the coal. This $CO_2$ also displaces water in the coal interstices and prevents reabsorption of water by the coal following pretreatment.

BRIEF DESCRIPTION OF DRAWINGS

A full understanding of the invention can be gained from the following description of the preferred embodiments when read in conjunction with the following drawings in which.

DETAILED DESCRIPTION OF THE PREFERRED EMBODIMENTS

Figure 1:
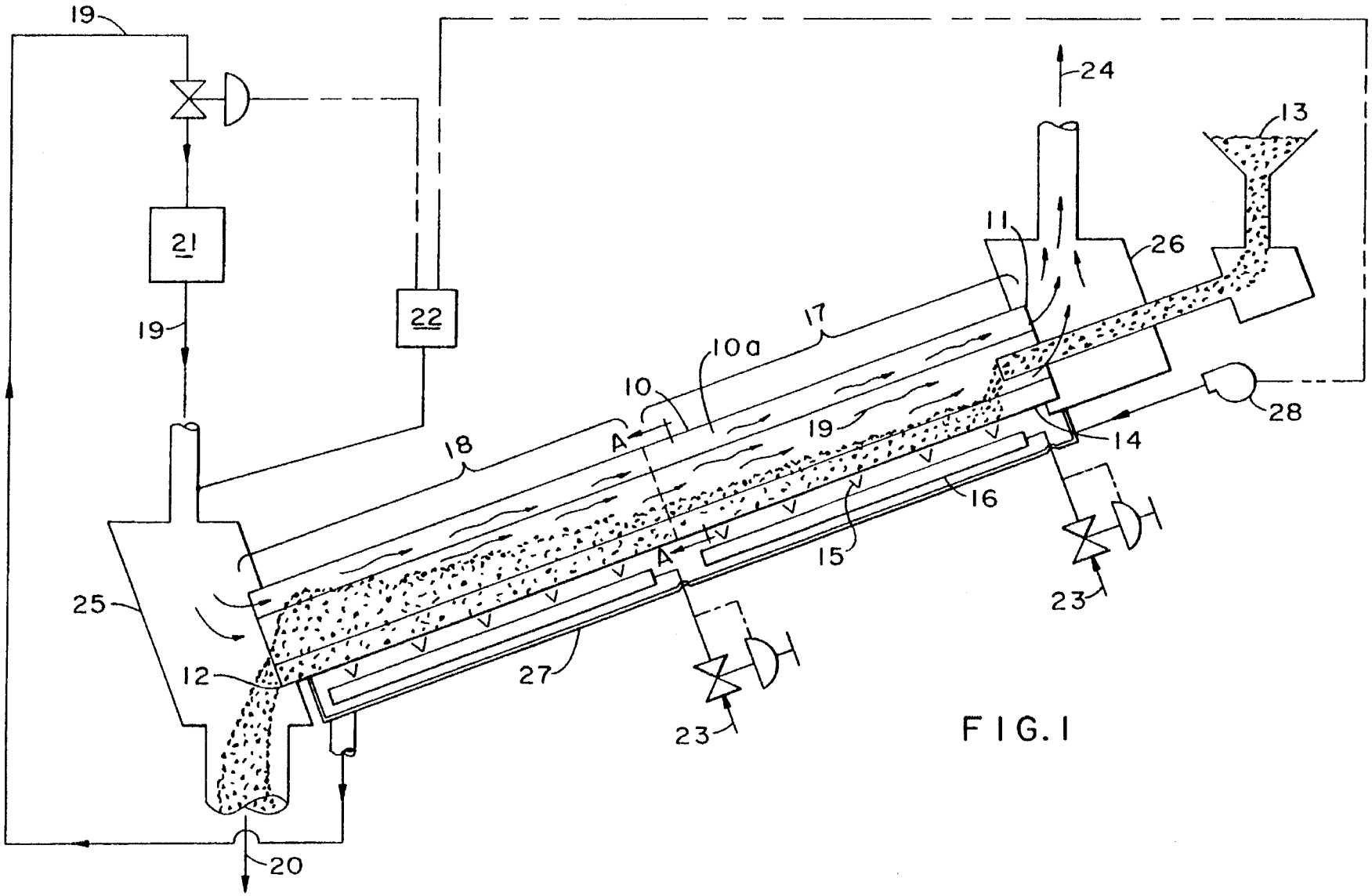
FIG. 1 is a schematic illustration in partial cross section illustrating a preferred method of practicing the invention.

FIG. 1 illustrates schematically a retort useful in carrying out a preferred method of the invention. As illustrated, a flighted cylindrical retort, generally 10, is inclined slightly from the horizontal. As used herein, the term "horizontal" with respect to retorts is intended to include those inclined at a slight angle as illustrated in FIG. 1, but not vertical retorts. The retort 10 has an inlet 11 with an inlet housing 26 through which raw coal, generally 13 is allowed to pass and an outlet 12 with a discharge housing 25 through which treated coal 20 passes. The retort may be any known retort and the design of the retort comprises no part of this invention, except as described herein with respect to the claimed method. Such inclined retorts are used for calcining, for example, and include a rotation assembly which permits the entire retort to rotate at predetermined and variable speeds. The retort 10 may also be of the vertical type, having contact trays within, known in the art as "vertical tray driers."

As illustrated, the retort 10 is heated on the outside shell by external heating devices such as flames 15 from gas fired burners 16. Gas or other fuel 23 supplies these burners 16. Other heat sources may be used, such as hot flue gas and other fuels such as oil, treated or untreated coal, wood, etc., could also be used to provide the heat or flame 15 for externally heating the shell 14.

Figure 2:
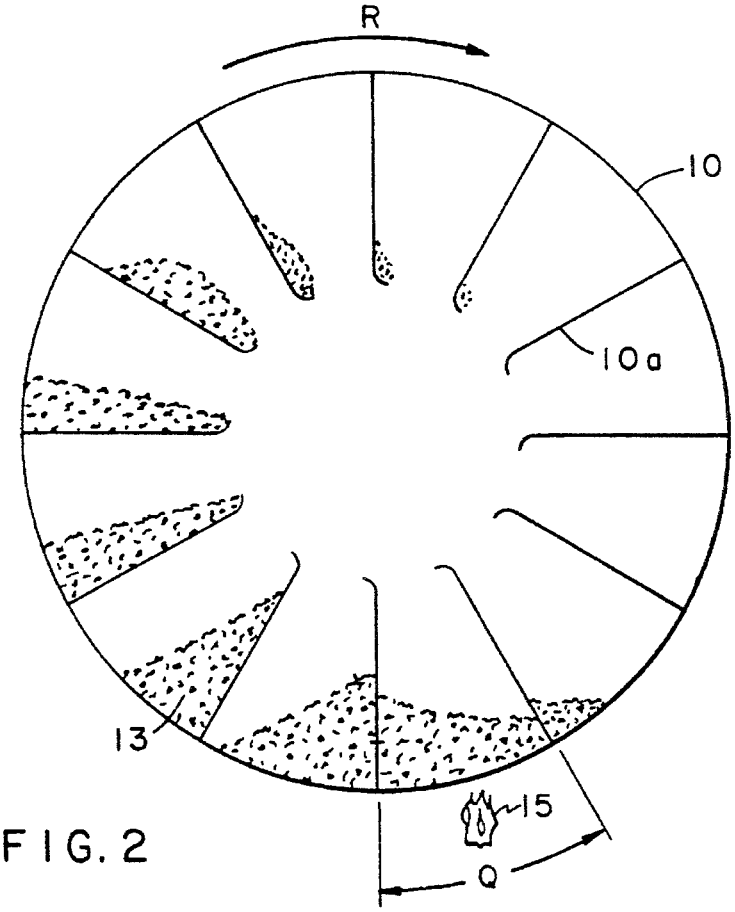
FIG. 2 is a cross sectional view taken generally along the lines A—A of FIG. 1.

The shell 14, in the drying section 17, is heated to an external shell temperature of about 500°–1000° F. As illustrated in FIG. 2, the retort 10 includes flights 10*a*, which allow the coal 13 to be carried partially around the retort 10 as it rotates in the direction R. The flights 10*a* also permit blanket gas passing through the retort 10 to better pass through and contact the coal 13. As shown, it is preferred that the lower 1/12 quadrant, Q, of the descending side of the shell be heated. This lower 1/12 quadrant coincides with the area of the rotating retort in which the coal 13 tends to accumulate when rotated in the direction R as shown, during its passage through the retort to the outlet 12 of the retort.

As the raw coal 13 containing up to about 50% moisture by weight enters the heated retort 10, it immediately contacts the hot shell 14 and is shock heated such that the surface of the coal is exposed to the 500°– 1000° F. shell temperatures and quickly achieves a maximum surface temperature approaching about 500°–1000° F. It is during this rapid heating or shock heating sequence that substantially all of the moisture initially contained in the coal is driven off from the coal. The coal passes through the retort 10 from a drying section, 17, into a treating section 18. The treating section 18 is also equipped with burners 16, but this section is maintained at a lower temperature than the 500°–1000° F. drying section, generally about 300°–550° F. external shell temperatures. Because of minimal heat losses, the internal surface of the retort achieves a temperature substantially equal to the external surface thereof.

As the shock heated coal passes into the treating section 18, it comes into contact with a cooling blanket gas, generally 19, which blanket gas assists in quickly cooling the shock heated coal before the coal becomes substantially exothermic. As used herein, the term "exothermic" with respect to coal means coal which self-ignites due to elevated temperature, and is able to sustain burning without application of additional heat once ignited, as opposed to exothermic behavior due to non-ignited coal losing heat, for example, due to water evaporation from the coal. The blanket gas 19 entering the retort 10 preferably contains about 2–8% oxygen by volume of the blanket gas. We have surprisingly found that this quantity of oxygen is required in the blanket gas entering the retort in order to achieve the improved results described herein. Following the treating of the coal, the treated coal 20 is recovered as illustrated.

As further illustrated in FIG. 1, it is preferred that the blanket gas 19 be passed through the coal 13 in a direction countercurrent to the direction of the coal passing through the retort 10. However, it would be possible to practice the invention without utilizing this countercurrent flow, and crosscurrent or cocurrent blanket gas flows could also be used. The blanket gas 19 is preferably controlled with a heat exchanger 21 capable of heating or cooling the blanket gas 19 to a temperature of about 300°–450° F. prior to entering the retort 10.

It is important that the oxygen content of the blanket gas be maintained within the range of about 2–8% by volume of the blanket gas 19 entering the retort 10. This may be done by simply providing this amount of oxygen to the blanket gas 19. However, since coal tends to liberate oxygen as it is heated, there may be a tendency for the oxygen content of the blanket gas within the retort 10 to be higher than that of the blanket gas 19 entering the retort. For this reason, it is most preferred that a feedback system or control device, generally 22, be used to continuously monitor the oxygen content of the blanket gas 19 within the discharge housing 25 of the retort 10 and control the oxygen fed to the blanket gas 19 such that the oxygen content within the discharge housing 25 is maintained at the preferred concentration of 2–8% oxygen by volume of the blanket gas within the discharge housing. The control device 22 is of the type known in the art. When varying amounts of oxygen are needed, the control device may work either by regulating the flow of blanket gas, the flow of oxygen, or the flow of non-oxygen gas contained in the blanket gas mixture.

The blanket gas preferably comprises a mixture of oxygen and inert gas such as combustion gases or flue gases. Alternatively, the inert gas may comprise nitrogen. In a highly preferred embodiment of the invention, the burners 16 are housed in a housing, generally 27, through which combustion air, preferably containing excess air in controlled amounts, passes, exiting the burner housing 27 at about the required 2–8% by volume oxygen content as determined by controlling the rate of air flow by a combustion air blower 28. This combustion gas is then fed to the retort 10 as blanket gas after being controlled to the blanket gas temperatures specified herein by the heat exchanger 21.

The flow rate of the blanket gas will vary, depending upon the other variables of the system, such as moisture content of the coal, temperature within the retort 10, residence time of the coal within the retort, and composition of the blanket gas 19. The flow rate of the oxygen lean blanket gas is not critical, provided the gas produces the desired result, namely assists in cooling the shock heated coal, prevents the coal from becoming exothermic as the coal passes through the drying section 17 and the treating section 18, and due to the oxygen content of the blanket gas, catalyzes the molecular transformation of the coal as discussed herein.

As used herein the term "oxygen lean" with respect to the blanket gas means blanket gas having an oxygen content lower than air, but with sufficient oxygen to achieve a catalytic effect causing rapid chemical and physical changes in the molecular structure of coal treated according to the process of the invention. The preferred range of oxygen is about 2–8% oxygen by volume of blanket gas entering the retort. Experiments have shown that treatment using blanket gas without oxygen in this range will generally not provide the desired molecular simplification. This is true even though oxygen is released from the coal in the drying section 17 and treatment section 18. This released oxygen is quickly removed by the flow of blanket gas. Also, unless oxygen is supplied with the blanketing gases entering the treatment zone 18, the formation of carbon dioxide does not occur and therefore the coal exiting the retort at 20 will not have the necessary gases to fill the voids left by the removal of water from the interstices of the coal. Most preferably, at least about 4% oxygen by volume of blanket gas entering the retort is used.

The temperature of the treated coal should be maintained at an internal temperature of about 350°–500° F. The flow rate of the coal, blanket gas volume and temperature, shell temperature, rotative speed of the retort, and residence time of the coal in the retort are controlled such that the coal internal temperature never rises above 550° F., and such that as the treated coal leaves the retort 10 it has achieved a substantially uniform temperature of about 350°–550° F. throughout the coal particle. This is accomplished through the effect of heat transfer wherein the shock heated coal rapidly and simultaneously transfers the high surface temperature heat of the coal (up to about 1000° F.) in the drying section inwardly towards the center of the coal particle, as the outer surface of the coal is simultaneously being cooled by the absorption of heat by the water content of the coal, and by the tendency for the temperature of coal, being heated by an external source, not to rise above about 390°–570° F. until the molecular transformation of the hydrocarbon content of the coal has been completed. Additionally, the coal temperature is further held below exothermic temperature by the cooling blanket gas entering the retort. Because the center of the coal is initially cooler than the blanket gas temperature, thermal gradients favor heat transfer from the coal surface inwardly.

The process of the invention is able to reduce the moisture content of the coal down to 1% or less and in some cases as low as 0.1% and even 0% and provides up to 95–99% molecular transformation of the hydrocarbon molecules in the coal to simpler molecules capable of rapid combustion.

In a highly preferred embodiment of the invention, coal fines of about −30 mesh are removed from the coal prior to treating the coal according to the method of the invention. These fines generally contain a high fraction of ash and pyrites, which tend to limit the flame reactivity. Thus, a highly reactive alternative fuel is produced, suitable, for example, for use in solid fuel igniters.

Figure 3:
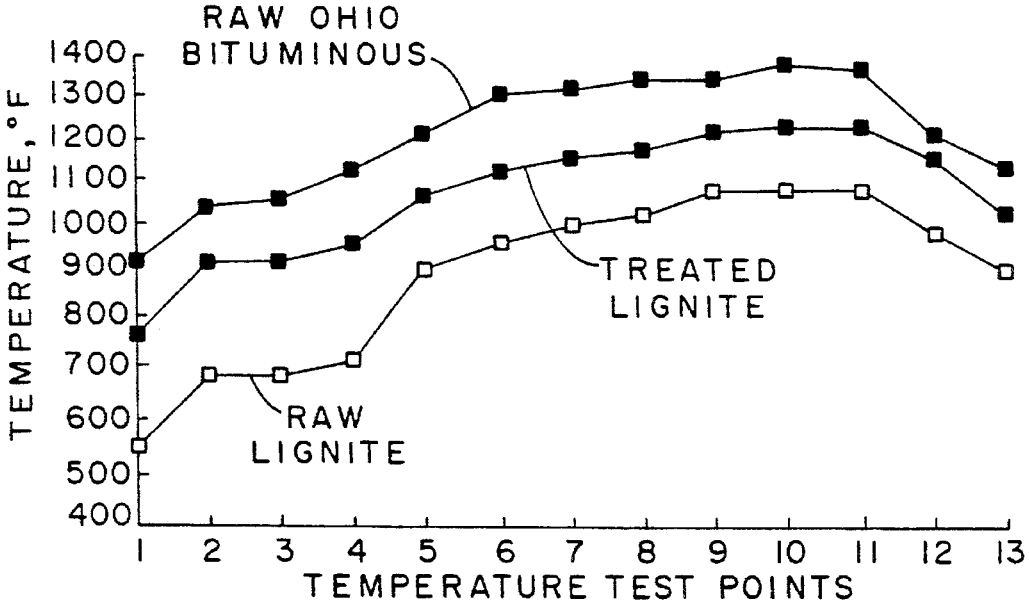
FIG. 3 is a graphical illustration demonstrating advantages of the present invention.

The process of the invention has demonstrated the added advantage of increasing the rank of the coal often by as much as 1–2 ranks. FIG. 3 illustrates that when raw lignite is treated according to the method of the present invention, the treated lignite demonstrates a furnace combustion temperature profile very near to that of raw Ohio bituminous coal.

It has been surprisingly found that the treated coal prepared according to the present invention achieves a molecular transformation which enhances the combustion characteristics of the coal. Specifically, we have found that the treatment process of the invention weakens the hydroxyl and carboxyl bonds of the coal without pyrolizing the coal, such that when the treated coal is burned, it burns more efficiently, more cleanly and more quickly. We have further found that when the alternative fuel produced according to the invention is burned, it tends to generate carbon dioxide rather than other more undesirable gases. The process of the present invention has demonstrated an ability to transform the molecular structure of the carbonaceous material contained in the coal into simpler forms of char, gaseous hydrocarbons, and a mixture of carbon monoxide and hydrogen. This simplification or transformation produces fuels capable of the rapid oxidation required of an efficient fuel.

As the moisture is removed from the coal, it has been found that the blanket gas and/or $CO_2$ generated by the treatment process is absorbed into the coal and replaces the moisture in the coal interstices such that moisture is not reabsorbed into the coal after treatment. This is an important aspect of the invention, as it permits treated coal to be shipped long distances at lighter weights without fear of having moisture reabsorbed into the coal.

There are several external observations that are preferably made during the treatment process according to the invention, in order to determine the treatment parameters which need to be varied to achieve maximum treatment effectiveness. One such indicator is the amount of unburned carbon expelled from the furnace, boiler, etc., used to burn the treated coal. When even small amounts of carbon are expelled, this may indicate that the alternative fuel has not received the maximum physical transformation of the molecular structure of the carbonaceous material and that one or more of the treatment parameters discussed herein, such as residence time, are required to be varied during treatment. A second indicator is the amount of smoke generated when the alternative fuel is burned. Even small amounts of smoke indicate that the fuel may not have received sufficient treatment and that one or more of the treatment parameters, such as residence time, need to be changed. Still another indicator is the delay in ignition after the treated fuel and combustion air are injected into the furnace, boiler, etc. The amount of delay should be designed to provide for sufficient flame propagation to develop the maximum heat generation in the superheater zone of the boiler. Excessive ignition delay could cause unburned fuel to be carried out with the flue gas, causing poor combustion efficiency, while no delay could indicate that the fuel has a flame that is too reactive.

EXAMPLES

Raw coal containing approximately 25% moisture by weight was continuously fed into the raised end of a cylindrical inclined flighted retort at a feed rate of 0.298 pounds per minute. The retort was heated externally with gas flame on the lower 1/12 quadrant of the descending side until the retort shell temperature was about 1,000° F. A blanket gas containing about 5% by volume oxygen and remainder nitrogen was fed countercurrently into the discharge end of the inclined flighted retort at a flow rate of about 0.441 pounds per minute and a temperature of 430° F. Treated coal was removed from the treating section of the retort at a rate of about 0.224 pounds per minute and flue gas was removed from the inlet end of the retort at a flow rate of about 0.515 pounds per minute. The flue gas contained nitrogen, oxygen and water vapor. A 20 pound sample of coal was treated in this fashion continuously until all of the coal was used up after about 67 minutes.

Table 1 demonstrates the improved results of coal treated according to the present invention, prepared in a manner similar to that described above, versus the same coal untreated (raw). Sample Number 1 was treated according to the invention to a coal temperature of about 420°–440° F., Sample Number 2 440°–460° F. and Sample Number 3 460°–480° F. The material tested in the Table 1 data was Pennsylvania bituminous coal and the test results were obtained by BCR National Laboratory.

As illustrated in Table 1, the moisture content of the treated coals was reduced from 0.6% moisture of the raw coal to 0.08–0.11% moisture by weight in the three treated coals. Table 1 also demonstrates that no volatiles are lost during the treatment process of the invention.

TABLE 1

| | REPORT OF ANALYSIS DRY BASIS Sample Number: | | | |
|---|---|---|---|---|
| | Raw | #1 Treated | #2 Treated | #3 Treated |
| % Moisture | 0.60 | 0.11 | 0.08 | 0.08 |
| % Ash | 6.74 | 6.90 | 6.84 | 6.69 |
| % Volatiles | 37.40 | 37.40 | 37.00 | 36.80 |
| % Fixed Carbon | 55.86 | 55.70 | 56.16 | 56.51 |
| % Sulfur | N/A | N/A | N/A | N/A |
| C.V. in Btu/lb | 13,944 | 13,941 | 13,980 | 13,966 |
| F.S.I. No. | 8.50 | 8.50 | 8.50 | 8.50 |
| Carbon % | 76.80 | 71.80 | 75.10 | 83.30 |
| Hydrogen % | 5.20 | 5.08 | 4.88 | 5.31 |
| Nitrogen % | 1.33 | 1.73 | 1.15 | 1.34 |
| $O_2$ (by diff.) | 8.15 | 12.73 | 10.24 | 4.62 |

Figure 4:
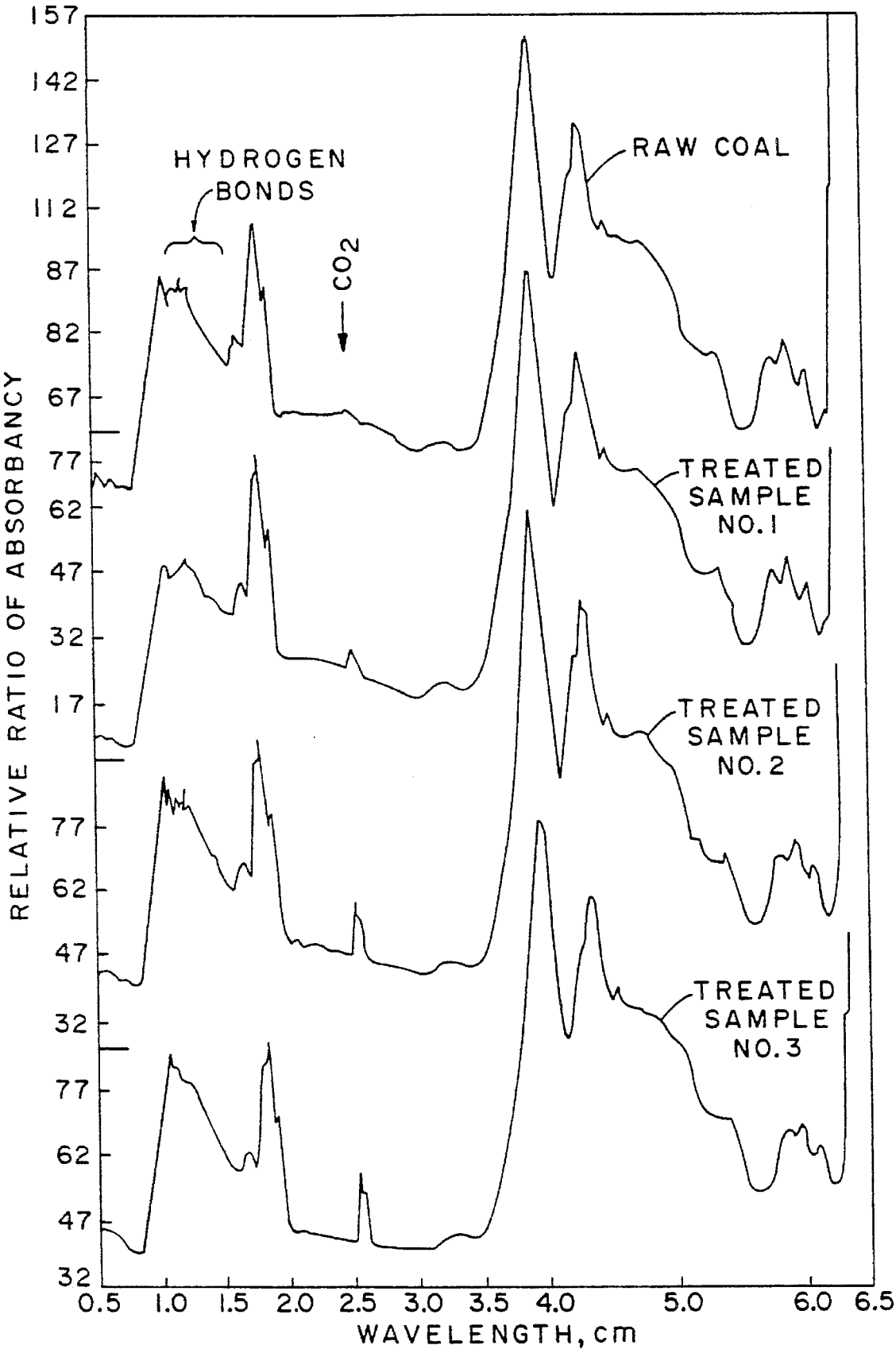
FIG. 4 is a series of four superimposed infrared spectral graphs demonstrating advantages of the invention.

FIG. 4 illustrates an infrared analysis of the raw and treated Pennsylvania bituminous coals reported in the data in Table 1. As illustrated, the infrared results of FIG. 4 demonstrate a decrease in the abundance of hydrogen bonds and an increase in the absorbed $CO_2$ after treating the coal according to the process of the invention. This molecular change indicates that lower ignition temperatures will be exhibited by fuels treated according to the present invention.

The information developed by this test shows that the treatment of the invention caused a weakening and rearrangement of the hydroxyl and carboxyl bonds in the treated coal samples. This is an indication that the transformation of the complex molecular structure of the carbonaceous material in the coal samples treated according to the method of invention not only occurred, but that the process of the invention results in treated coal which stops progression of the physical and chemical changes prior to formation of the gaseous state of the fuel. Further, these results prove that the transformation process is non-reversible and therefore, the treated fuel of the invention will retain the improved combustion characteristics imparted during treatment until such time as the treated coal is burned as alternative fuel. Such alternative fuel will require considerably less heat to be absorbed from the combustion zone for final gasification. Thus, greater combustion efficiency is achieved by the alternative fuel prepared according to the invention.

Table 2 illustrates the proximate analysis of raw coal and coal treated according to the present invention. Sample Number 1 was Pennsylvania bituminous coal, Sample Number 2 was Texas lignite and Sample Number 3 was Montana sub-bituminous coal. As Table 2 illustrates, the method of the present invention decreased the moisture content of the coal in each case and significantly increased the BTU content of the coal in each case. The results of Table 2 were also obtained by BCR National Laboratory.

TABLE 2

| | Sample No.: 1 | | 2 | | 3 | |
|---|---|---|---|---|---|---|
| | As Rec'd. | Dry | As Rec'd. | Dry | As Rec'd. | Dry |
| RAW FUEL | | | | | | |
| % Moisture | 1.20 | | 28.50 | | 23.00 | |
| % Ash | 6.80 | 6.90 | 16.80 | 23.40 | 4.70 | 6.11 |
| % Volatiles | 36.20 | 36.60 | 37.10 | 52.00 | 41.50 | 53.90 |
| % Fixed Carbon | 55.80 | 56.50 | 17.60 | 24.60 | 30.80 | 39.99 |
| % Sulfur | 1.19 | 1.30 | 0.90 | 1.30 | 0.35 | 0.46 |
| Btu's | 13,700 | 13,865 | 6,951 | 9,722 | 9,343 | 12,143 |
| M&A Free | 14,896 | | 12,707 | | 12,933 | |
| TREATED FUEL | | | | | | |
| % Moisture | 0.00 | | 2.00 | | 0.81 | |
| % Ash | 6.60 | 6.60 | 17.20 | 17.60 | 5.22 | 5.26 |
| % Volatiles | 36.70 | 36.70 | 44.30 | 45.20 | 43.32 | 43.67 |
| % Fixed Carbon | 56.70 | 56.70 | 36.50 | 37.20 | 50.65 | 51.07 |
| % Sulfur | 1.30 | 1.30 | 1.60 | 1.70 | 0.38 | 0.39 |
| Btu's | 14,252 | 14,252 | 10,215 | 10,424 | 12,427 | 12,507 |
| M&A Free | 15,264 | | 12,642 | | 13,201 | |

It is, of course, contemplated to be within the province of those of ordinary skill in the art to recognize that the parameters of residence time, blanket gas composition, processing temperature and rate of heating may need to be varied in order to achieve the advantages of the present invention for different applications and types of coal being processed. For example, a treated coal that does not achieve sufficient moisture removal may indicate that the residence time in the retort should be increased. Similarly, a tendency for the coal to go exothermic may indicate that the oxygen content of the blanket gas or retort shell temperature should be reduced.

The present invention has been described above in terms of specific embodiments which are representative of the invention. The particular examples described herein are merely illustrative of the invention, however, which is defined more generally by the following claims and their equivalents. While many objects and advantages of the invention have been set forth, it is understood that the invention is defined by the scope of the following claims, not by the objects and advantages.

I claim:

1. An improved fuel coal made by the process of:

passing said coal through externally heated rotating retort means having an external shell temperature of about 500°–1000° F. in the drying section and an external shell temperature of about 350°–550° F. in the treatment section;

shock heating said coal in the drying section of said retort means, thereby driving off said moisture from said coal such that said coal contains about 1% or less by weight moisture;

treating said shock heated dried coal in the treating section of said retort means wherein the surface of said dried coal witnesses a temperature of 350°–550° F. by heating the shell to this temperature and causing the coal to be maintained at a temperature of 300°–450° F. for a sufficient time period by passing a cooling oxygen lean blanket gas stream, maintained at about 2–8% oxygen concentration by volume, at said 300°–450° F., thus causing the oxygen content of said blanket gas to catalyze the molecular simplification of it surface hydrocarbon molecules without allowing said coal to become exothermic; and recovering said treated coal from said retort means.

2. The improved fuel coal of claim 1 including effecting external heating of said retort means by hot gas or flame.

3. The improved fuel coal of claim 1 including passing said blanket gas through said shock heated coal countercurrent to the direction of said coal passing through said retort means.

4. The improved fuel coal of claim 1 including continuously monitoring and controlling said oxygen content of said blanket gas by gas monitoring and control means.

5. The improved fuel coal of claim 1 wherein said process further comprises employing said blanket gas composed of a mixture of oxygen and combustion gases.

6. The improved fuel coal of claim 1 wherein said process further comprises employing said blanket gas composed of a mixture of oxygen and nitrogen.

7. The improved fuel coal of claim 1 wherein said process further comprises the step of employing as said fuel coal a coal containing up to about 50% by weight moisture prior to said treating.

8. The improved fuel coal of claim 1 wherein said process further comprises the steps of employing an inclined rotary horizontal righted cylindrical retort and heating said shell on the lower 1/23 quadrant on the descending side of said retort.

9. The improved fuel coal of claim 1 further comprising the step of employing as said fuel coal particle a coal having a particle size of about 2" maximum×0".

10. The improved fuel coal of claim 1 further comprising the step of removing –30 mesh coal fines prior to treating said coal.

11. The improved fuel coal of claim 1 further comprising the step of using a rotating vertical retort for said retort.

12. The improved fuel coal of claim 1 made by the process comprising the step of absorption of the major portion of the heat required for molecular simplification of hydrocarbon molecules while retaining the reduced moisture content of 1% or less, greatly retarding rehydration, retaining virtually all of the carbon and volatiles and increasing the heating value.

* * * * *

UNITED STATES PATENT AND TRADEMARK OFFICE

CERTIFICATE OF CORRECTION

PATENT NO. : 5,468,265

DATED : November 21, 1995

INVENTOR(S) : ROBERT J. ADAMS

It is certified that error appears in the above-identified patent and that said Letters Patent is hereby corrected as shown below:

Claim 1, column 9, line 26, "it" should be deleted.

Claim 8, column 10, line 16, "righted" should be --flighted--.

Claim 8, column 10, line 17, "1/23" should be --1/12--.

Signed and Sealed this

Fourth Day of March, 1997

*Attest:*

*Attesting Officer*

BRUCE LEHMAN

*Commissioner of Patents and Trademarks*